US008567828B2

(12) United States Patent
Andrén et al.

(10) Patent No.: US 8,567,828 B2
(45) Date of Patent: Oct. 29, 2013

(54) SNAP-TYPE LOCKING DEVICE

(75) Inventors: Mårten Andrén, Täby (SE); Hans Himbert, Bromma (SE); Conny Jansson, Västerås (SE)

(73) Assignee: Kapman AB, Sandviken (SE)

( * ) Notice: Subject to any disclaimer, the term of this patent is extended or adjusted under 35 U.S.C. 154(b) by 943 days.

(21) Appl. No.: 11/883,647

(22) PCT Filed: Jan. 7, 2006

(86) PCT No.: PCT/SE2006/000174
§ 371 (c)(1),
(2), (4) Date: Aug. 3, 2007

(87) PCT Pub. No.: WO2006/083225
PCT Pub. Date: Aug. 10, 2006

(65) Prior Publication Data

US 2008/0309096 A1 Dec. 18, 2008

Related U.S. Application Data

(60) Provisional application No. 60/655,725, filed on Feb. 24, 2005.

(30) Foreign Application Priority Data

Feb. 7, 2005 (SE) ..... 0500283

(51) Int. Cl.
*E05C 5/00* (2006.01)

(52) U.S. Cl.
USPC ..... 292/66; 292/113

(58) Field of Classification Search
USPC ..... 292/66, 80, 84, 87, 113
See application file for complete search history.

(56) References Cited

U.S. PATENT DOCUMENTS

| | | | | | |
|---|---|---|---|---|---|
| 2,548,367 | A | * | 4/1951 | Harris | 292/113 |
| 2,829,912 | A | * | 4/1958 | Koch | 292/114 |
| 2,876,516 | A | * | 3/1959 | Cummings | 24/638 |
| 2,998,272 | A | * | 8/1961 | Newcomer, Jr. et al. | 292/66 |
| 3,109,675 | A | * | 11/1963 | Anderson | 292/109 |
| 3,237,978 | A | * | 3/1966 | Swanson | 292/113 |
| 3,542,410 | A | * | 11/1970 | Poe | 292/113 |
| 4,049,301 | A | * | 9/1977 | Schenk | 292/113 |

(Continued)

FOREIGN PATENT DOCUMENTS

DE 20 004 014 409 U1 11/2004

OTHER PUBLICATIONS

Supplementary European Search Report dated Jun. 28, 2011 issued in the corresponding European Patent Application No. 06716875.

*Primary Examiner* — Kristina Fulton
(74) *Attorney, Agent, or Firm* — Buchanan Ingersoll & Rooney PC

(57) ABSTRACT

The present invention relates to a snap-type locking device for releasable and principally external keeping together of two parts and comprising at least one grip part at least one grip part, at least one movable arm and at least one spring, said at least one movable arm being turnably attached to said at least one grip part as well as, directly or indirectly, to a first part of said two parts. Said at least one spring abuts said at least one grip part in order to urge the same in a direction away from said two parts.

11 Claims, 4 Drawing Sheets

(56) References Cited

U.S. PATENT DOCUMENTS

| | | | | | |
|---|---|---|---|---|---|
| 4,181,333 | A | * | 1/1980 | Stelma | 292/66 |
| 4,213,643 | A | * | 7/1980 | Blind et al. | 292/247 |
| 4,268,073 | A | * | 5/1981 | Hibbert | 292/113 |
| 4,270,668 | A | * | 6/1981 | Berfield | 220/324 |
| 4,283,081 | A | * | 8/1981 | Shalaev et al. | 292/113 |
| 4,522,436 | A | * | 6/1985 | Hoen et al. | 292/113 |
| 4,627,650 | A | * | 12/1986 | Hauschulte | 292/113 |
| 4,679,833 | A | * | 7/1987 | Dueringer | 292/113 |
| 4,782,673 | A | * | 11/1988 | Castelli et al. | 70/72 |
| 4,890,869 | A | * | 1/1990 | Langkamp, Jr. | 292/113 |
| 4,991,885 | A | * | 2/1991 | Poe | 292/113 |
| 5,127,684 | A | * | 7/1992 | Klotz et al. | 292/113 |
| 5,257,839 | A | * | 11/1993 | Nielsen et al. | 292/113 |
| 5,271,649 | A | * | 12/1993 | Gromotka | 292/113 |
| 5,480,197 | A | * | 1/1996 | Ernst et al. | 292/113 |
| 5,511,834 | A | * | 4/1996 | Willems | 292/203 |
| 6,022,055 | A | * | 2/2000 | Coulonvaux et al. | 292/113 |
| 6,032,988 | A | * | 3/2000 | Klein | 292/247 |
| 6,076,865 | A | * | 6/2000 | Sokurenko et al. | 292/113 |
| 6,457,750 | B1 | * | 10/2002 | Sokurenko et al. | 292/113 |
| 6,547,293 | B1 | * | 4/2003 | Cheng | 292/247 |
| 6,840,551 | B2 | * | 1/2005 | Evans | 292/113 |
| 7,048,464 | B2 | * | 5/2006 | Ronnquist | 403/321 |
| 7,568,739 | B2 | * | 8/2009 | Lee | 292/80 |
| 2002/0093203 | A1 | * | 7/2002 | Moretz | 292/113 |
| 2006/0049640 | A1 | | 3/2006 | Lee | |
| 2008/0309096 | A1 | * | 12/2008 | Andren et al. | 292/66 |

* cited by examiner

Fig. 13
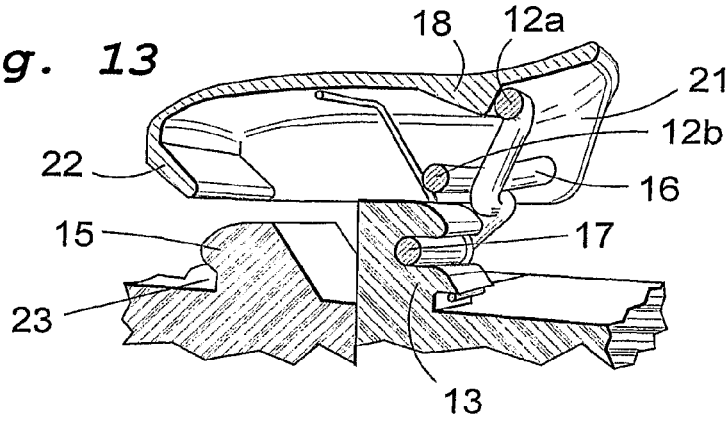
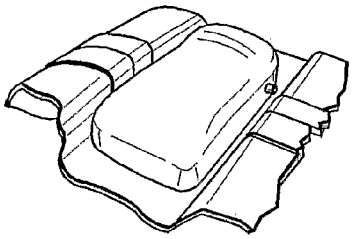
Fig. 14
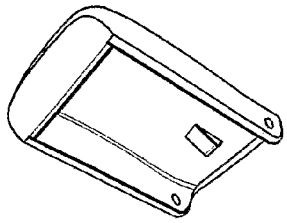
Fig. 16
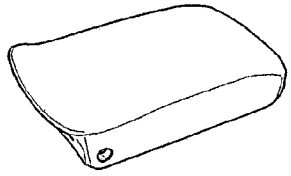
Fig. 15
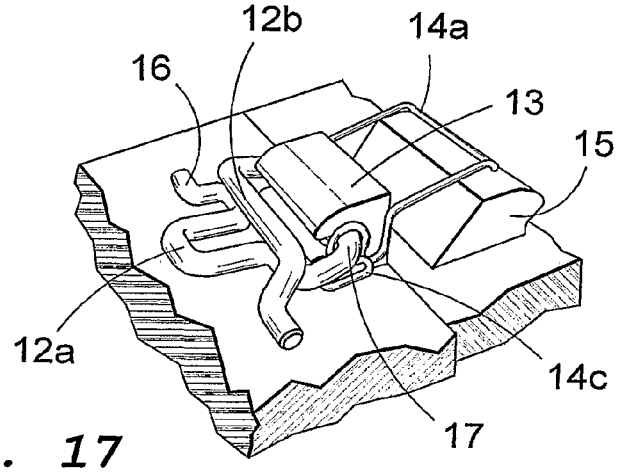
Fig. 17

SNAP-TYPE LOCKING DEVICE

The application claims benefit of Provisional Application No. 60/655,725, filed Feb. 24, 2005.

The present invention relates to a snap-type locking device for releasable and principally external keeping together of two parts and comprising at least one grip part, at least one movable arm and at least one spring, said at least one movable arm being turnably attached to said at least one grip part as well as, directly or indirectly, to a first part of said two parts.

PRIOR ART

U.S. Pat. No. 2,829,912 discloses draw bolts for luggage. Each draw bolt or locking device has a grip part, a movable arm and springs. The springs are not arranged to urge the grip part in a direction away from the luggage, and therefore unintentional locking or sticking may occur in the unlocked position.

SUMMARY OF THE INVENTION

A first object of the invention is to provide a snap-type locking device that is convenient to lock and unlock and convenient to use also in the unlocked state in such a way that the lock not unintentionally gets stuck in the locked or semi-locked position. A second object of the invention is to provide a snap-type locking device having fewer components included than in locks of known types. A third object of the invention is to provide a snap-type locking device that is simple and therefore cost-effective to produce.

Hence, the invention embodies a snap-type locking device for releasable and principally external keeping together of two parts and comprising at least one grip part, at least one movable arm and at least one spring, said at least one movable arm being turnably attached to said at least one grip part as well as, directly or indirectly, to a first part of said two parts. Said at least one spring abuts against said at least one grip part in order to urge the same in a direction away from said two parts.

Said at least one spring may abut against a first side, facing said two parts, of said at least one grip part.

Said at least one movable arm may be turnable around a first axis of rotation in relation to said at least one grip part and turnable around a second axis of rotation in relation to said first part. Said at least one movable arm may be turnably or fixedly attached to at least one fixed arm, which in turn is turnably or fixedly attached to said first part. Said at least one fixed arm may be a part of the locking device. Said at least one fixed arm may be a part of said first part. Said at least one fixed arm may be integral with said first part.

Said at least one spring may comprise at least one anchoring spring leg, which extends from a second axis of rotation, around which said at least one movable arm may be arranged to turn in relation to said first part, and into a recess, slot or the like in said first part, and/or in an additional part attached to said first part, in order to, in this way, prevent said at least one spring in its entirety from being turned around said second axis of rotation.

Said at least one spring may be equipped with at least two urging spring legs, which extend at an angle in relation to each other from said second axis of rotation into abutment against a first side, facing said two parts, of said at least one grip part in such a way that at least a first urging spring leg of said at least two urging spring legs can bring said at least one grip part to turn in a first direction around said second axis of rotation and at least a second urging spring leg of said at least two urging spring legs can bring said at least one grip part to turn in a second direction around said second axis of rotation, said second direction being counter-directed to said first direction and a state of equilibrium occurring when the locking device is in the unlocked position. In said state of equilibrium, said at least one grip part may be positioned in a free position at a distance from said two parts. A main extension plane of said at least one grip part may, in the unlocked position, extend principally parallel to a main extension plane of said at least one grip part in the locked position.

Each one of two movable arms may be turnably attached to said at least one grip part as well as, directly or indirectly, to said first part, wherein the arms may constitute a unit together with a first spindle, coinciding with a first axis of rotation, and a second spindle, coinciding with said second axis of rotation, in order to move together, wherein each one of the spindles may extend between and unite the arms, wherein said first spindle, in the unlocked position, may abut against at least one of said at least a first and a second urging spring legs.

Said at least one spring may abut against a first side, facing said two parts, of said at least one grip part of a spring side of a plane that intersects a main extension plane of said at least one grip part under a principally right angle and that simultaneously passes through, and principally parallel to, a second axis of rotation, around which said at least one movable arm may be arranged to turn in said first part and vice versa, wherein at least a first arm leg of said at least one movable arm, in the unlocked position, may abut against at least one fold on said first side of an arm side of said plane, wherein said spring side and said arm side may be different sides of said plane.

At least a second arm leg of said at least one movable arm may, in the unlocked position, abut against said at least one spring, wherein said at least one grip part may be positioned in a free position at a distance from said two parts. Said main extension plane of said at least one grip part may, in the unlocked position, extend principally parallel to said main extension plane of said at least one grip part in the locked position.

Said at least one movable arm may be turnable around a first axis of rotation in relation to said at least one grip part and may be formed in such a way that it simultaneously constitutes a first spindle, at least partly coinciding with said first axis of rotation, and a second spindle, at least partly coinciding with said second axis of rotation, wherein a first end of said at least one movable arm may be mounted in a bearing in a recess suitable therefor in a first flange of said at least one grip part, a second end of said at least one movable arm may be mounted in a bearing in a recess suitable therefor in a second flange of said at least one grip part and a portion of said at least one movable arm occurring therebetween may be mounted in a bearing in a recess suitable therefor in said first part, and/or in an additional part attached to said first part.

LIST OF DRAWINGS

FIG. 13 shows, in a sectioned perspective view from the left, the locking device of FIG. 6 in the unlocked state.

FIG. 14 shows, in a perspective view from the left, the locking device of FIG. 6 in the locked state.

FIG. 15 shows, in a perspective view from the right and from above, a part of the locking device of FIG. 6.

FIG. 16 shows, in a perspective view from the right and from below, the part according to FIG. 15.

FIG. 17 shows, in a perspective view from the right, parts of the locking device of FIG. 6.

DESCRIPTION OF EMBODIMENTS

Figure 1:
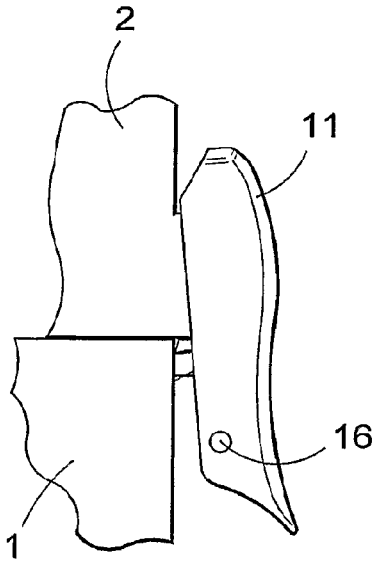
FIG. 1 shows, in a side view from the left, a first embodiment of a locking device according to the invention and in the locked state.
Figure 2:
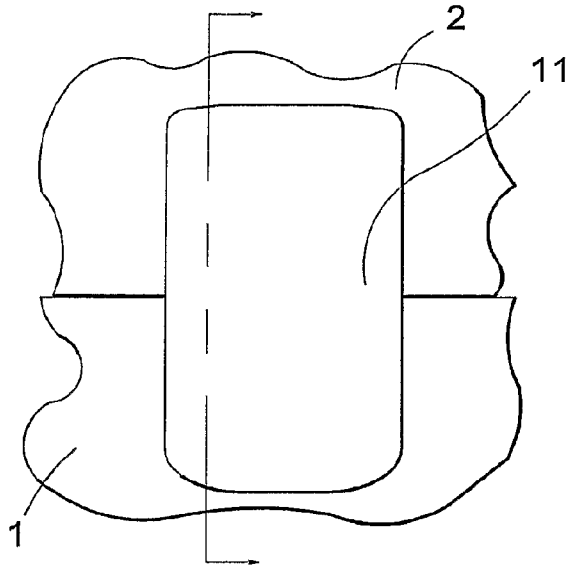
FIG. 2 shows, in a front view, the locking device of FIG. 1.
Figure 3:
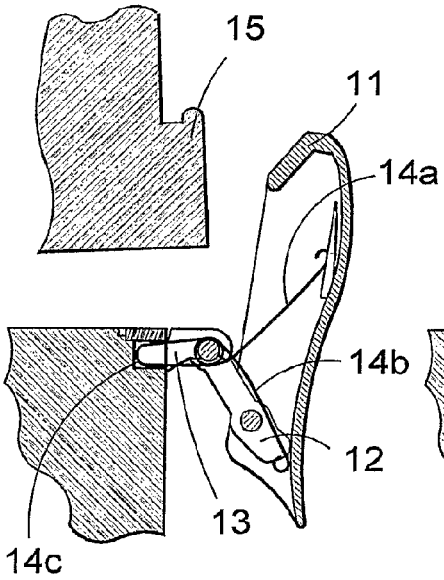
FIG. 3 shows, in a partly sectioned side view from the left, the locking device of FIG. 1 in the unlocked state.

A first embodiment of the locking device has an appearance and a function in accordance with the FIGS. 1-5. The locking device is mounted on a first part 1, for instance a bottom part 1 of a case, and comprises a grip part 11, two movable arms 12 and two springs 14. Said grip part 11 is turnably attached to each one of the movable arms 12 (and vice versa), each one of which in turn is turnably attached to one and the same fixed arm 13, which is attached to the first part 1. Said springs 14 hold, in the unlocked state, the grip part 11 at a certain distance from not only the first part 1 but also a second part 2, such as, for instance, a lid part 2 of a case.

The movable arms 12 are turnable around a first axis of rotation 16, which coincides with a spindle 16, in relation to the grip part 11 and turnable around a second axis of rotation 17, which coincides with a spindle 17, in relation to the fixed arm 13 and thereby simultaneously to the first part 1. Two urging spring legs 14*a*, 14*b* of each spring 14, i.e., totally four urging spring legs, extend in pairs at an angle in relation to each other from said second axis of rotation 17 into abutment against a first side 11*a* of the grip part 11, i.e., the side of the grip part 11 that is facing the first and second parts 1, 2. A first urging spring leg 14*a* of said two urging spring legs 14*a*, 14*b* of each spring 14 brings the grip part 11 to turn in a first direction around said second axis of rotation 17 and a second urging spring leg 14*b* of said two urging spring legs 14*a*, 14*b* of each spring 14 brings the grip part 11 to turn in a second direction around said second axis of rotation 17, said second direction being counter-directed to said first direction and contributing to the fact that a state of equilibrium occurs when the locking device is in the unlocked position.

The mutually principally parallel arms 12 constitute a unit together with the mutually principally parallel first and second spindles 16, 17 and move together with them. Each one of the spindles 16, 17 extends, at a distance from each other, between and unites the arms 12 and meets the arms 12 at principally right angles. In the unlocked position, the spindle 16 abuts, by the spring action described above from occurring spring legs, against a 14*b* of the urging spring legs 14*a*, 14*b* of each pair, i.e. of each spring 14, which acts as an anchorage for the entire locking device in the unlocked state. In this anchored position, a main extension plane of the grip part 11 extends principally parallel to a main extension plane of the grip part 11 in the locked position of the locking device.

Rotation of each one of the occurring springs 14 around the spindle 17, in connection with the operation of the locking device and/or upon storage, can be avoided by the fact that each spring 14 also comprises an anchoring spring leg 14*c*, which extends from the spindle 17 and into a recess in said first part 1.

Each spring 14 is ingeniously manufactured in one piece from a wire of metal or the like, which has been formed to, in a first end, show the spring leg 14*a* in abutment against the side 11*a* of the grip part 11 in order to, therefrom, extend towards the spindle 17 and around the same at least one turn in order to further extend down into the recess in the first part 1 and there form a loop included in the anchoring spring leg 14*c* and extend back to the spindle 17 and around the same at least one turn in order to further extend at an angle in relation to the spring leg 14*a* in the direction of the side 11*a* of the grip part 11 in order to be terminated in the form of the spring leg 14*b* in abutment against the side 11*a*. The two springs 14 are mounted in each end of the spindle 17 and the angle between the two urging spring legs 14*a*, 14*b* of each spring 14, as well as the anchoring spring leg 14*c* of the same spring 14, is in one and the same plane, which is principally perpendicular to the direction of extension of each one of the spindles 16, 17.

A second embodiment of the locking device has a geometry and a function in accordance with the FIGS. 6-17, FIGS. 15 and 16 of which only show the grip part 11 and FIG. 17 only shows the other parts. Here, only one movable arm 12 is present, which is formed in such a way that it alone gives the same possibilities of operation as two arms and two spindles together according to the first embodiment of the invention. Thus, the movable arm 12 is turnable around a first axis of rotation 16 in relation to the grip part 11 and is formed in such a way that it simultaneously constitutes a first spindle 16, at least partly coinciding with said first axis of rotation 16, and a second spindle 17, at least partly coinciding with said second axis of rotation 17. A first end of said movable arm 12 is mounted in a bearing in a recess suitable therefor in a first flange 20 in the grip part 11 while a second end of said movable arm 12 is mounted in a bearing in a recess suitable therefor in a second flange 21 in the grip part 11. A portion of said movable arm 12 occurring therebetween is mounted in a bearing in a recess suitable therefor in an arm or a projection 13 attached to said first part 1.

Only one spring 14 is present, which abuts against said first side 11*a* of a spring side of a plane that intersects a main extension plane of the grip part 11 under a principally right angle and that simultaneously passes through, and principally parallel to, said second axis of rotation 17. A first arm leg 1 2*a* of said movable arm 12 abuts, in the unlocked position, against at least one fold 18 on said first side 11*a* of an arm side of said plane, said spring side and said arm side being different sides of said plane. A second arm leg 12*b* of said movable arm 12 abuts, in the unlocked position, against said spring 14, said grip part 11 being in a free position at a distance from said two parts 1, 2. In this anchored position, a main extension plane of the grip part 11 extends principally parallel to a main extension plane of the grip part 11 in the locked position of the locking device.

Each spring 14 is ingeniously manufactured in one piece from a wire of metal or the like, which has been formed to, in a first end, start from a dedicated groove 19 in said projection 13 attached to said first part 1 in order to, therefrom, extend out of this groove 19 and towards the spindle 17 and around the same in order to further extend in the direction of the side 11*a* of the grip part 11 into abutment against the side 11*a* in order to further extend along the side 11*a* in a direction that is principally parallel in relation to the principal direction of extension of the spindle 17 in order to, therefrom, again extend towards the spindle 17 and around the same in order to further extend in the direction of said groove 19 in said projection 13 in order to, in said groove 19, be terminated in the form of a second end. The part of the spring 14 that is between the spindle 17 and the grip part 11 may be regarded as an urging spring leg 14*a*, while the parts of the spring lo 14 that are between the spindle 17 and the groove 19 in said projection 13 may be regarded as anchoring spring legs 14*c*, which accordingly prevent rotation of the entire spring 14 around the spindle 17.

Figure 4:
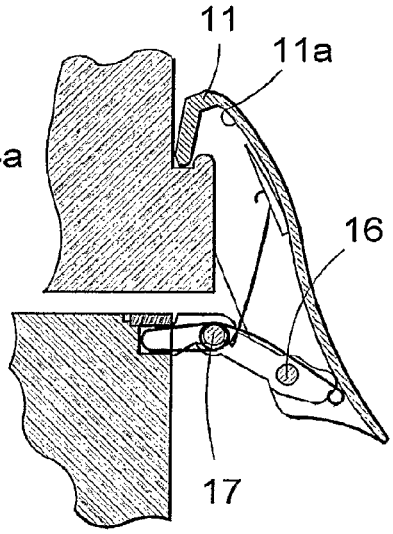
FIG. 4 shows, in a partly sectioned side view from the left, the locking device of FIG. 1 in a semi-locked state.
Figure 5:
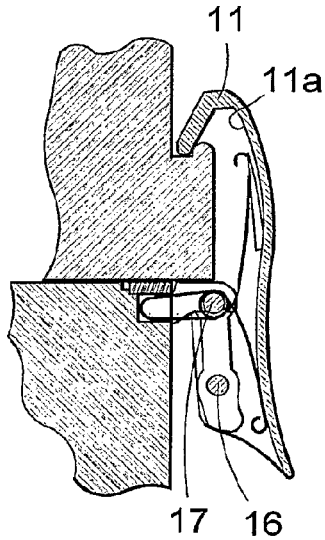
FIG. 5 shows, in a partly sectioned side view from the left, the locking device of FIG. 1 in the locked state.
Figure 6:
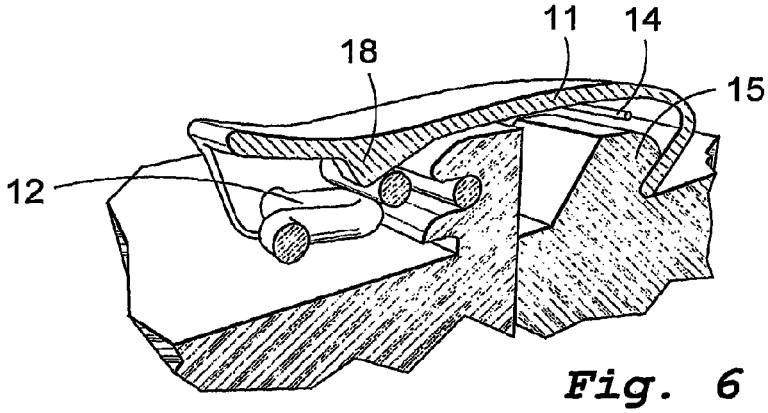
FIG. 6 shows, in a sectioned perspective view from the right, a second embodiment of a locking device according to the invention and in the locked state.
Figure 7:
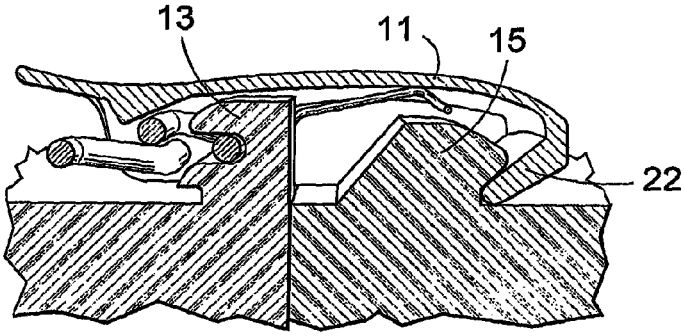
FIG. 7 shows, in a sectioned side view from the right, the locking device of FIG. 6 in the locked state.
Figure 8:
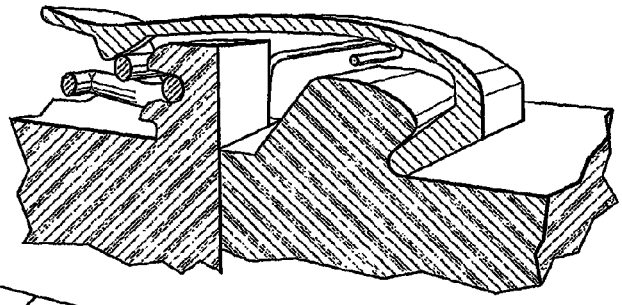
FIGS. 8 and 9 show, in sectioned perspective views from the right, the locking device of FIG. 6 in the locked state.
Figure 9:
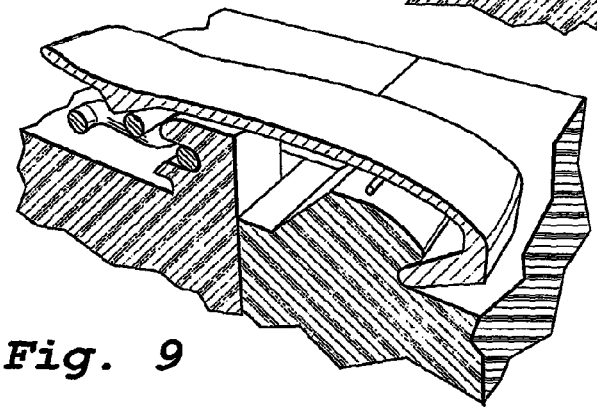
Figure 10:
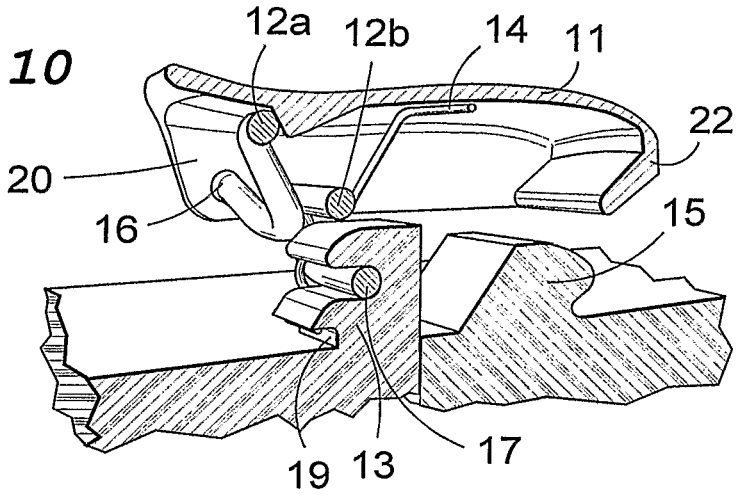
FIGS. 10 and 11 show, in sectioned perspective views from the right, the locking device of FIG. 6 in the unlocked state.
Figure 11:
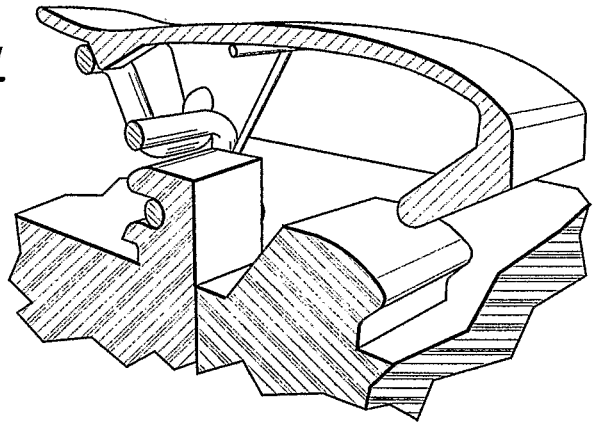
Figure 12:
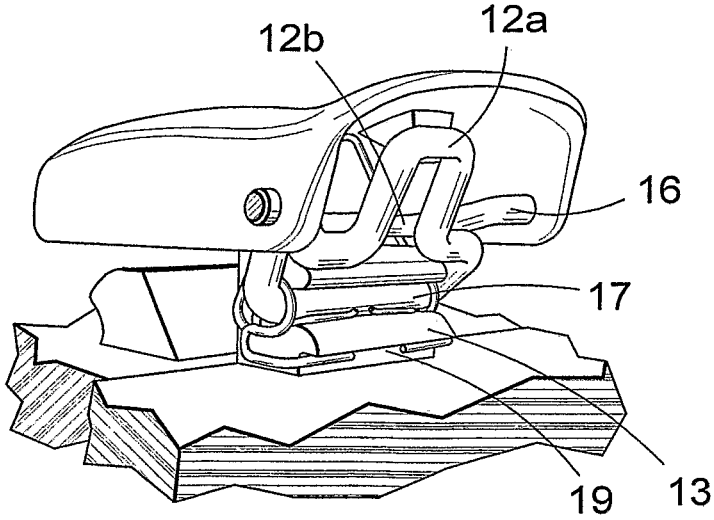
FIG. 12 shows, in a perspective view from the left, the locking device of FIG. 6 in the unlocked state.

Upon closure including subsequent locking, a front/upper part of the grip part 11 can be forced over a fold 15 present on the second part 2, see FIG. 4, and then the locking device can be brought to lock together the second part 2 and the first part 1 by snap action by the fact that a rear/lower part of the grip part 11 is pressed against the first part 1, see FIG. 5. Said front/upper part of the grip part 11 is provided with a third flange 22 particularly adapted for the purpose, the main extension plane of which forms principally the same angle with the main extension plane of the grip part 11 as does a main extension plane of a particularly adapted recess 23 in said fold 15 in the unlocked as well as the locked state of the locking device. From, for instance, FIG. 7, it is seen that the angle, which may vary between close to 0° and close to 90°, in the present case is approx. 45°. Upon unlocking, said rear/lower part of the grip part 11 can instead be retreated from the first part 1, see FIG. 4, after which said front/upper part of the grip part 11 can be removed from the fold 15 present on the second part 2, see FIG. 3.

The locking device is particularly suitable for a tool case of plastic provided with two locking devices, but a number of other application areas are feasible such as, for instance, most known types of cases, boxes, drawers, fittings and various forms of building elements etc. The number of locking devices of each application object may vary and, for instance, a case is conceivable having one or more locking devices. Distances between occurring locking devices and their placement on the case or the like may also vary.

The parts included in the locking device are preferably manufactured from metal but any other expedient material is feasible, for instance, various forms of plastic. Also combinations of different materials are feasible, such as, for instance, a grip part 11 of plastic and a movable arm 12 and a spring 14 of metal. Also combinations of different materials in one and the same part is feasible.

The invention is not limited to the embodiments shown here but may be varied within the scope of the subsequent claims.

The invention claimed is:

1. Locking device for releasable and principally external keeping together of two parts and comprising at least one grip part, at least one movable arm and at least one spring, said at least one movable arm being turnably attached to said at least one grip part as well as, directly or indirectly to a first part of said two parts, said at least one spring abutting against said at least one grip part in order to urge the same in a direction away from said two parts, characterized in that said at least one spring comprises at least one anchoring spring leg which extends from a first axis of rotation, around which said at least one movable arm is arranged to turn in relation to said first part, and into a recess or slot in said first part, or in an additional part attached to said first part, in order to, in this way, prevent said at least one spring in its entirety from being turned around said first axis of rotation, wherein said at least one spring abuts against a first side, facing said two parts, of said at least one grip part on a spring side of a plane that intersects a main extension plane of said at least one grip part under a principally right angle and that simultaneously passes through, and principally parallel to, said first axis of rotation, around which said at least one movable arm is arranged to turn in said first part and vice versa, at least a first arm leg of said at least one movable arm, in the unlocked position, abutting against at least one projection on said first side on an arm side of said plane, said spring side being divided from said arm side by said plane, and wherein one of said at least one movable arm is turnable around a second axis of rotation in relation to said at least one grip part and is formed in such a way that it simultaneously constitutes a first spindle, coinciding with said second axis of rotation, and a second spindle, coinciding with said first axis of rotation, a first end of a one of said at least one movable arm being mounted in a bearing in a recess in a first flange of said at least one grip part, a second end of the one of said at least one movable arm being mounted in a bearing in a recess in a second flange of said at least one grip part and a portion of the one of said at least one movable arm occurring therebetween being mounted in a bearing in a recess in said first part, or in an additional part attached to said first part.

2. Locking device according to claim 1, wherein provided that said at least one movable arm being indirectly turnably attached to said first part, said at least one movable arm is turnably or fixedly attached to at least one fixed arm, which in turn is attached to said first part.

3. Locking device according to claim 2, wherein said at least one fixed arm is a part of the locking device.

4. Locking device according to claim 2, wherein said at least one fixed arm is a part of said first part.

5. Locking device according to claim 4, wherein said at least one fixed arm is integral with said first part.

6. Locking device according to claim 1, wherein said at least one spring is equipped with at least two urging spring legs, which extend at an angle in relation to each other from said first axis of rotation into abutment against said first side, facing said two parts, of said at least one grip part in such a way that at least a first urging spring leg of said at least two urging spring legs brings said at least one grip part to turn in a first direction around said first axis of rotation and at least a second urging spring leg of said at least two urging spring legs brings said at least one grip part to turn in a second direction around said first axis of rotation, said second direction being counter-directed to said first direction and a state of equilibrium occurring when the locking device is in the unlocked position.

7. Locking device according to claim 6, wherein, in said state of equilibrium, said at least one grip part is in a free position at a distance from said two parts.

8. Locking device according to claim 7, wherein a main extension plane of said at least one grip part in the unlocked position extends principally parallel to a main extension plane for said at least one grip part in the locked position.

9. Locking device according to claim 6, 7 or 8, wherein each one of two movable arms is turnably attached to said at least one grip part as well as, directly or indirectly, to said first part, the arms constituting a unit together with the first and the second spindle, each one of the spindles extending between and uniting the arms, said first spindle, in the unlocked position, abutting against at least one of said at least a first and second urging spring legs.

10. Locking device according to claim 1, wherein at least a second arm leg of said at least one movable arm, in the unlocked position, abuts against said at least one spring, said at least one grip part being in a free position at a distance from said two parts.

11. Locking device according to claim 10, wherein said main extension plane of said at least one grip part in the unlocked position extends principally in parallel to said main extension plane of said at least one grip part in the locked position.

* * * * *

UNITED STATES PATENT AND TRADEMARK OFFICE

CERTIFICATE OF CORRECTION

PATENT NO. : 8,567,828 B2
APPLICATION NO. : 11/883647
DATED : October 29, 2013
INVENTOR(S) : Marten Andren et al.

It is certified that error appears in the above-identified patent and that said Letters Patent is hereby corrected as shown below:

TITLE PAGE at (22):

PCT Filed, delete "Jan. 17, 2006" and replace with "Feb. 7, 2006"

Signed and Sealed this
Twenty-ninth Day of April, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,567,828 B2
APPLICATION NO. : 11/883647
DATED : October 29, 2013
INVENTOR(S) : Andrén et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1068 days.

Signed and Sealed this
Fifteenth Day of September, 2015

Michelle K. Lee

Michelle K. Lee
*Director of the United States Patent and Trademark Office*